US006945599B2

(12) United States Patent
May

(10) Patent No.: US 6,945,599 B2
(45) Date of Patent: Sep. 20, 2005

(54) ROCKER RECLINER MECHANISM

(75) Inventor: Teddy J May, Moorsville, MS (US)

(73) Assignee: Lane Furniture Industries, Inc., Tupelo, MS (US)

( * ) Notice: Subject to any disclaimer, the term of this patent is extended or adjusted under 35 U.S.C. 154(b) by 0 days.

(21) Appl. No.: 10/673,220

(22) Filed: Sep. 30, 2003

(65) Prior Publication Data

US 2005/0067867 A1 Mar. 31, 2005

(51) Int. Cl.[7] ..... A47C 3/02
(52) U.S. Cl. ..... 297/270.1; 297/85; 297/DIG. 7
(58) Field of Search ..... 297/85, DIG. 7, 297/84, 270.1, 270.2, 270.3

(56) References Cited

U.S. PATENT DOCUMENTS 2,746,519 A * 5/1956 Krikorian ..... 297/269.1
2,817,388 A 12/1957 Knabusch et al.
2,892,485 A 6/1959 Schliephacke
3,012,816 A 12/1961 Lorenz et al.
3,103,381 A 9/1963 Schliephacke
3,104,128 A 9/1963 Schliephacke
3,279,847 A 10/1966 Ré
3,302,969 A 2/1967 Mizelle et al.
3,339,971 A 9/1967 Fletcher
3,352,601 A * 11/1967 Cycowicz ..... 297/85
3,464,736 A 9/1969 Mizelle
3,550,952 A 12/1970 Ferguson
3,622,198 A 11/1971 Ré
3,638,995 A 2/1972 Flanagan et al.
3,697,132 A 10/1972 Van Surksum
3,767,257 A * 10/1973 Rogers et al. ..... 297/85
3,768,859 A 10/1973 Rogers, Jr. et al.
3,802,735 A 4/1974 Ré
3,904,240 A 9/1975 Rogers, Jr. et al.
4,071,276 A * 1/1978 Cecil ..... 297/85
4,319,780 A * 3/1982 Rogers, Jr. ..... 297/85
4,367,895 A 1/1983 Pacitti et al.
4,601,513 A * 7/1986 Pine ..... 297/269.1
4,674,794 A 6/1987 Pine
4,707,025 A * 11/1987 Rogers, Jr. ..... 297/259.2
4,826,243 A 5/1989 Lawson
4,863,215 A 9/1989 Crum
4,904,019 A 2/1990 May
4,919,478 A 4/1990 Tacker
4,989,914 A 2/1991 Pine
5,013,084 A 5/1991 May
5,056,862 A 10/1991 May et al.
5,121,967 A * 6/1992 Rogers ..... 297/269.1
5,141,284 A 8/1992 LaPointe
5,156,441 A 10/1992 Byersmith et al.
5,340,191 A 8/1994 May
5,354,116 A 10/1994 May et al.
5,360,255 A 11/1994 Cook et al.
5,480,209 A 1/1996 May
5,527,095 A 6/1996 Marshall et al.
5,564,781 A * 10/1996 Pine ..... 297/267.1

(Continued)

*Primary Examiner*—Peter M. Cuomo
*Assistant Examiner*—Stephen D'Adamo
(74) *Attorney, Agent, or Firm*—Sutherland Asbill & Brennan LLP

(57) ABSTRACT

A mechanism for a rocker recliner chair is caused to have enhanced comfort and stability, to have enhanced ease of operation, and to require fewer parts for manufacture. The mechanism includes a rocker locking linkage arranged to include a drive link slidingly connected to a drive element, to drive a locking member for locking of the chair against rocking when the ottoman of the chair is extended. The drive link of the rocker locking linkage may also be arranged to be slidingly connected to a rocker cam assembly of the chair. The rocker locking linkage preferably includes a pair of locking links moveable to a substantially aligned orientation to lock a chair against forward rocking movement. The chair preferably includes an ottoman linkage including a slotted guide member.

5 Claims, 12 Drawing Sheets

U.S. PATENT DOCUMENTS 5,582,457 A 12/1996 Komorowski et al.
5,704,686 A 1/1998 May
5,800,010 A 9/1998 May
5,806,920 A 9/1998 Blount
5,806,921 A 9/1998 LaPointe et al.
5,845,961 A 12/1998 LaPointe et al.
5,876,094 A 3/1999 Hoffman
5,992,930 A 11/1999 LaPointe et al.
5,992,931 A 11/1999 LaPointe et al.
6,000,754 A * 12/1999 Lawson ..... 297/259.2
6,135,559 A 10/2000 Kowalski
6,142,558 A 11/2000 May
6,231,120 B1 5/2001 Wiecek
6,309,015 B1 * 10/2001 Pine ..... 297/85
6,634,706 B2 10/2003 May
6,729,686 B2 5/2004 May
6,733,071 B2 * 5/2004 Guillot et al. ..... 297/85

* cited by examiner

ROCKER RECLINER MECHANISM

BACKGROUND OF THE INVENTION

The present invention relates to a rocker reclining chair and a mechanism for such a chair, and especially to a rocker reclining chair and mechanism which provides a greater degree of comfort to a user, provides enhanced stability, particularly when the ottoman of the chair is extended, provides enhanced ease of operation, and which may require a reduced number of parts to manufacture.

Reclining chairs may be more comfortable if the chair's ottoman (also known as a leg rest or footrest) can be elevated and extended while the back of the chair is tilted rearward to allow the user to comfortably recline with his or her feet raised. A higher degree of elevation (or pitch) of the ottoman may provide a higher degree of comfort. However, a reclining chair that includes a rocker arrangement may become unstable when the ottoman is elevated and extended, unless a locking mechanism is provided to prevent rocking movement of the chair when the ottoman is in the extended position. Typical examples of prior art rocking reclining chairs that include locking mechanisms are shown in U.S. Pat. Nos. 6,000,754 and 4,601,513. Such mechanisms, which are typically handle-operated can be complex and include many pans in their linkages. A complex mechanism may be more difficult to manufacture and assemble, and may also require the user to apply an undesirable amount of force to the handle to operate the mechanism.

A need exists, therefore, for improved rocking reclining chair mechanisms that securely lock the chair to prevent rocking motion when the ottoman is in the extended position, while permitting the ottoman to reach a greater height for enhanced comfort. A need also exists for a rocking reclining chair that requires a reduced number of parts, so that manufacturing is more efficient and economical. A need also exists for a rocking reclining chair mechanism that can be operated easily by the user in comfort.

SUMMARY OF THE INVENTION

A recliner mechanism for a rocking chair provides stability while reclined at an increased pitch, may be economically manufactured, and provides ease of operation by the user, by having a rocker locking linkage to lock the chair against rocking motion when the ottoman of the chair is extended. The rocker locking linkage preferably includes a drive link slidingly connected to a drive element for driving a locking element to lock the chair against rocking motion. The main drive link may also be slidingly connected to a rocker cam assembly, and may drive two locking elements. The mechanism preferably includes an ottoman linkage having a guide link slidingly connected to the ottoman linkage. The mechanism also preferably includes a locking element to lock the chair against forward rocking motion by orienting pivoting locking members in a substantially aligned arrangement.

The principles of the invention will be further discussed with reference to the drawings in which preferred embodiments are shown. The specifics illustrated in the drawings are intended to exemplify, rather than limit, aspects of the invention as defined in the claims.

The terms "left" and "right," "front" and rear," and "forward" and "rearward" are used to describe the mechanism or chair from the viewpoint of a person occupying the chair. The "handle side" in the preferred embodiment is the right side of the chair. The term "longitudinal" is used to denote the front to rear direction, and the term "transverse" is used to denote the left-to-right direction.

DETAILED DESCRIPTION OF THE EMBODIMENTS OF THE INVENTION

Figure 1:
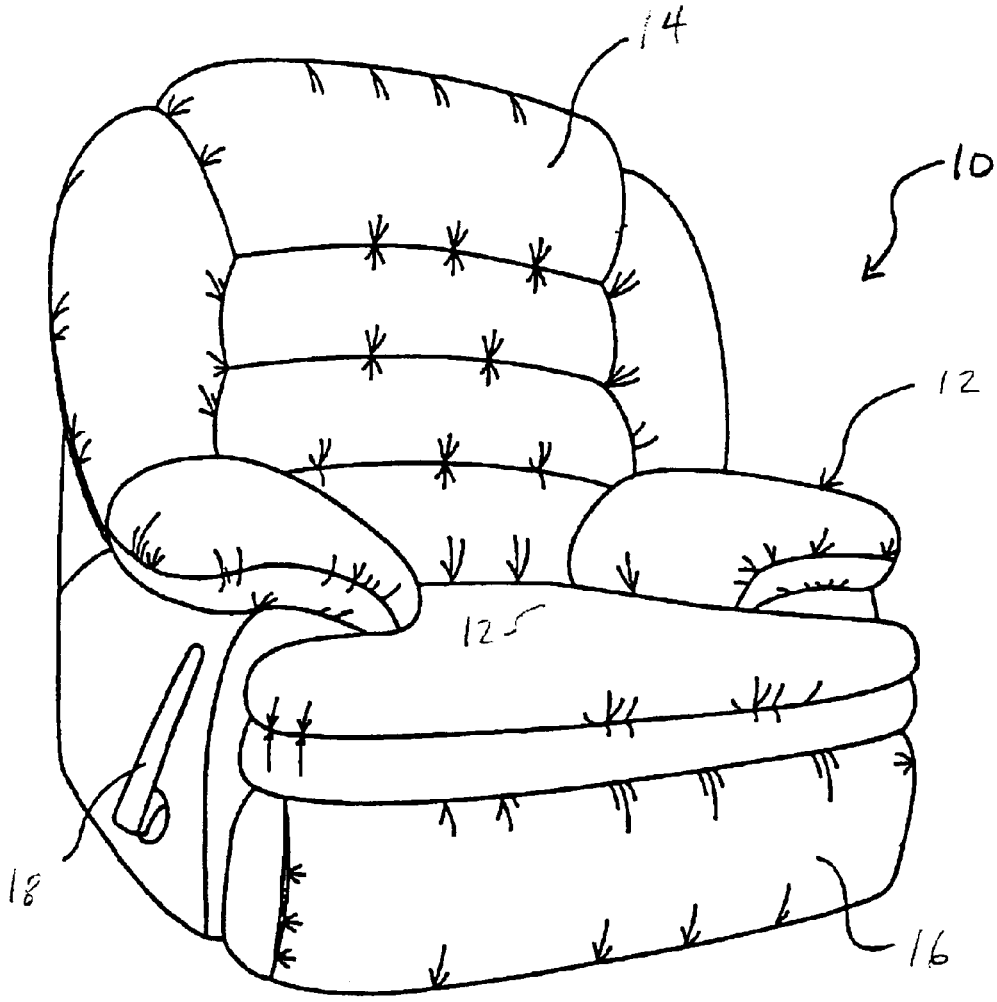
FIG. 1 is a perspective view of the exterior of a rocking reclining chair embodying the principles of the present invention.

The chair 10, as seen in FIG. 1, may be upholstered in fabric, leather, or other suitable material and includes an upholstered seat and arm frame unit 12, an upholstered back 14 and an upholstered ottoman 16. Only the primary member of the ottoman 16 shows in FIG. 1, the secondary member being stored out of view behind the primary member of ottoman 16 in the upright position of the chair. (It should be noted that ottomans are sometimes also known as legrests or footrests). In the illustrated embodiment, extension of the ottoman 16 is operated by handle 18, at least for initiation of the extension, as will be described presently.

Figure 2:
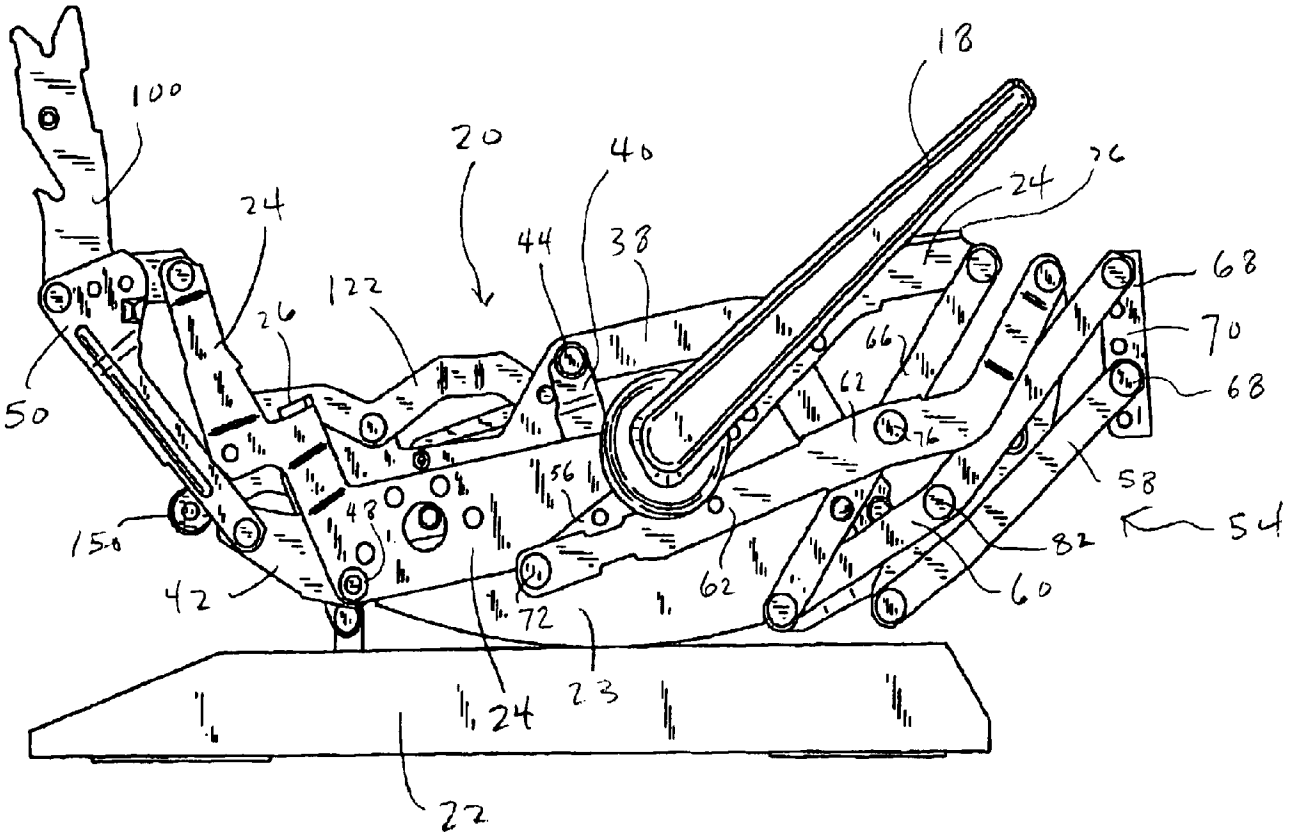
FIG. 2 is a side elevational view of the mechanism for the chair FIG. 1 (right side linkage), shown in the upright position.

A right-side rocking reclining mechanism 20 is shown in FIG. 2, viewed from a position rightward of the mechanism itself. A base member 22 is constructed of wood or other suitable material, and rests on a floor or other supporting surface. A rocker cam 23 rests on the base member 22, and has an arc-shaped lower surface to permit forward and rearward rocking motion. The rocker cam 23 is made of hardwood or other appropriate material, and bears on the base member 22 at a position intermediate the ends of the base member 22 to provide room for rocking motion of the rocker cam 23. The mechanism 20 includes a seat and arm mounting plate 24 including flange surfaces 26 on which the upholstered seat and arm unit 12 can be mounted. The left side mechanism 21 is shown in FIG. 3 and includes a corresponding left side base member 22 and seat and arm mounting plate 24.

In the manufacturing of reclining chairs, it is efficient to provide left and right sides of the base 22 and operating mechanism 20 as corresponding elements of prefabricated mirror image (left and right) subassemblies often known as side linkages, certain corresponding elements of which are then integrated together by transverse interconnecting elements. In FIGS. 2, 4 6, and 8, a right side mechanism of the present invention is illustrated, while in FIGS. 3, 5, 7 and 9, a left side mechanism is illustrated. Where left and right side parts are essentially mirror image components (such as the base members 22 and seat and arm frame mounting brackets 24, as well as others) only one reference number will be used in this description, but it should be understood that the reference number refers to both the right and left side parts. It should be noted that a preferred embodiment, the handle 18 is only included in the right side mechanism.

The right and left base members 22 are connected by transverse members 28, which can be made of wood or metal or other suitable material. Lower spring mounting blocks 30 are mounted on each base member 22 by nut and bolt sets, or other appropriate fasting method. A pair of springs 32 have their lower ends mounted in lower spring mounting blocks 30, and the upper ends of the springs 32 are mounted in upper spring mounting blocks 34, which are in turn fastened to rocker cam 23 by nut and bolt sets, or other appropriate fastening arrangement. The right and left rocker cams 23 are interconnected to each other by transverse members 36, which can be made of wood, metal or other suitable material as desired.

Figure 3:
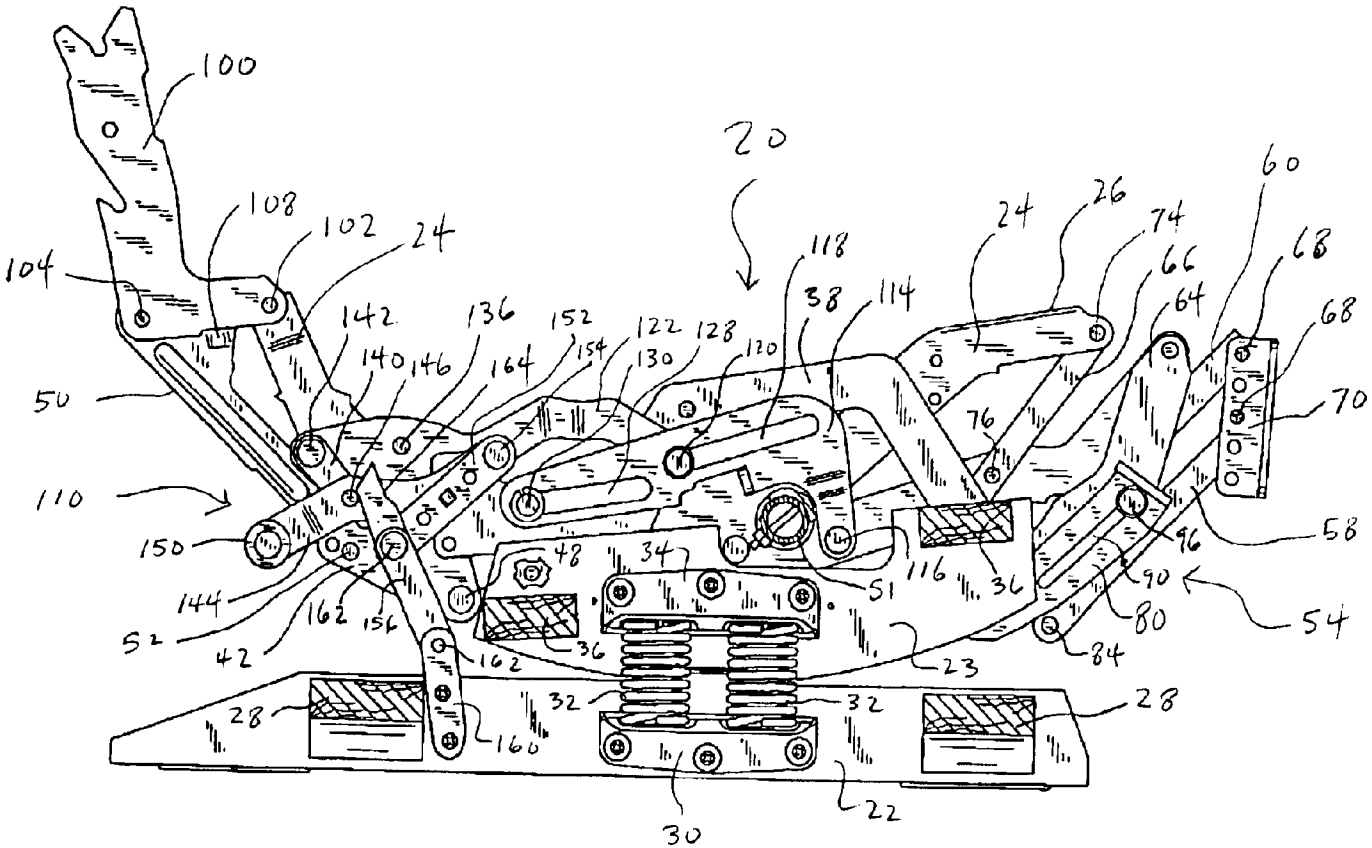
FIG. 3 is a side elevational view of the left side linkage of the mechanism in the same position as in FIG. 2, with transverse members and torque tube in section.

When the chair 10 is in its upright position as shown in FIGS. 1, 2 and 3, it is free to rock forwardly and rearwardly on the lower curved surfaces of the rocker cams 23. During rocking motion, the springs 32 serve to damp the rocking movement of the chair, and also provide a resilient "bounce" to assist the user in continuing the rocking motion. The springs 32, which as described above are held in the spring mounting blocks 30 and 34, also maintain the rocker cams 23 in the desired transverse position atop the left and right base members 22.

A support plate 38 is mounted atop each of the rocker cams 23 by machine bolts or other appropriate fastening method. Each support plate 38 is mounted in a fixed position relative to its corresponding rocker cam 23.

Each seat and arm mounting plate 24 is supported by one of the support plates 38 through a forward swing link 40 and a v-shaped link 42. The forward swing link 40 is pivotally connected to the support plate 38 by a pivot joint 44 as seen in, for example, FIGS. 4 and 5, and is pivotally connected to the seat and arm mounting plate 24 by a pivot joint 46. The v-shaped link 42 is pivotally connected to the seat and arm mounting plate 24 at its lower end by a pivot joint 48, and pivotally connected to a back connecting link 50 at its upper rearward end by a pivot joint 52. At its upper forward end, the v-shaped link 42 is pivotally connected to a longitudinal drive element 122, as will be described in more detail presently. Support of the arm and seat mounting plate 24 by the forward swing link 40 and v-shaped link 42 allows the seat and arm plate 24 to have a range of motion to vary the tilt of the seat of the chair for comfort, as will be described below.

Figure 4:
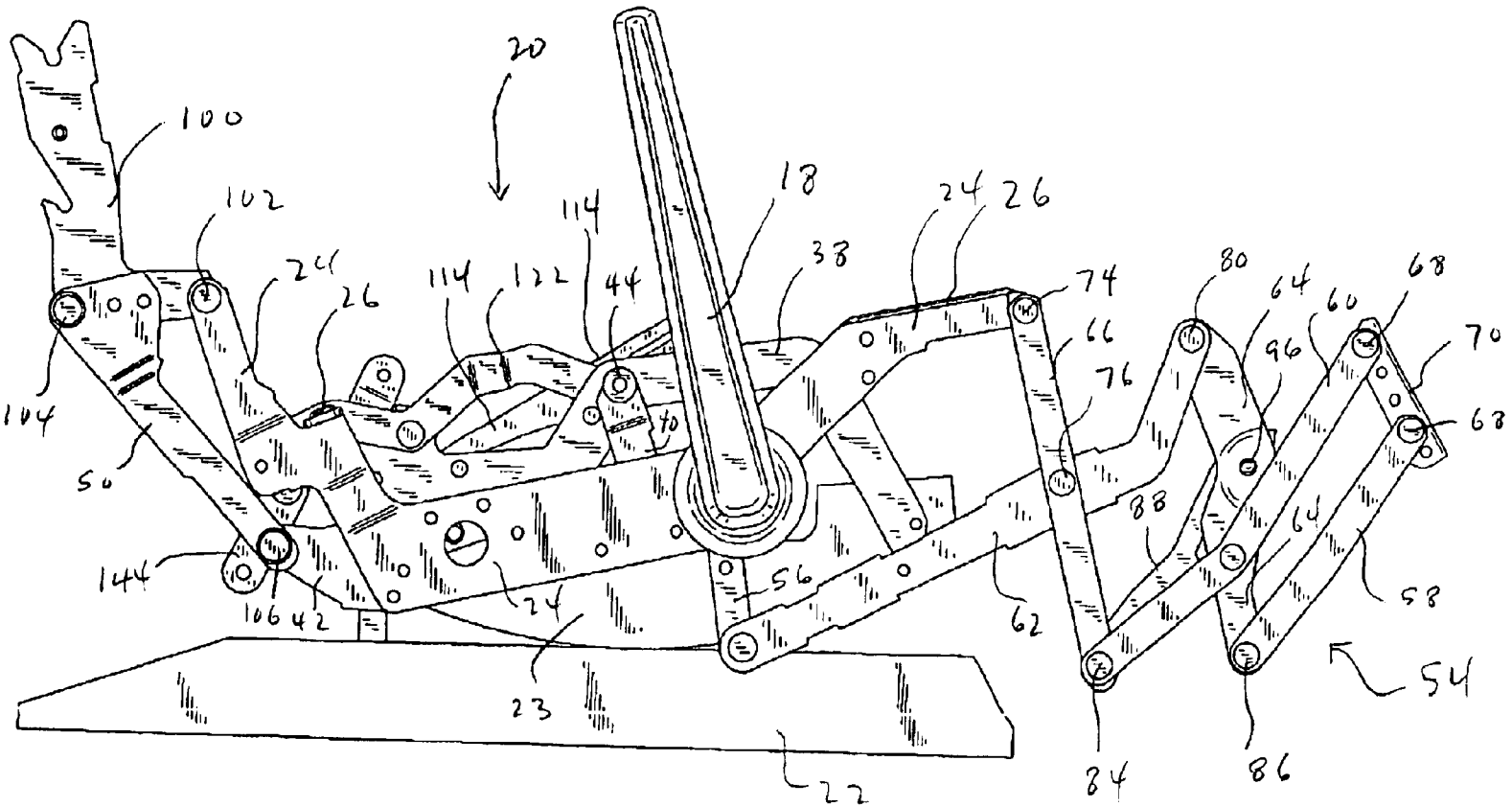
FIG. 4 is a side elevational view of the right side linkage of FIG. 2 with the ottoman linkage partially extended.

As seen in FIG. 4, each seat and arm mounting plate 24 is longitudinally elongated, disposed in a respective vertical plane, and is generally concave in shape as seen in side elevation. The operating handle 18 is mounted on an extension 49 of a transversely extending torque tube 51, opposite end portions of which are journaled in sleeve bearings mounted in each seat and arm mounting plate 24. The sleeve bearings (not shown) are made of nylon or other self-lubricating synthetic plastic material.

The upholstered ottoman 16 is mounted on left and right pantograph ottoman linkage sets 54, which form respective parts of the left and right side mechanisms 20. Each of these ottoman linkage sets 54 includes a crank link 56 that is fixedly connected to the torque tube extension 49, so that motion of the handle 18 may drive the ottoman linkage 54 for a movement between its extended and retracted positions. Each of the ottoman linkage sets 54 includes forward, middle and rear first links 53, 60 and 62; and forward and rear second links 64 and 66. Describing one side, the upper, forward ends of the links 58 and 60 are connected by pivot joints 68 to the vertical, longitudinal flange of a primary ottoman mounting bracket 70, which also includes a transverse flange to which the ottoman 16 is secured.

The crank link 56, which as noted is fixedly connected to the torque tube extension 49, is pivotally connected to the link 62 by a pivot joint 72 at the rearward end of the link 62. The link 66 is connected to the seat and arm mounting plate 24 by pivot joint 74. The links 62 and 66 cross each other in scissors-like fashion at intermediate portions of each of these respective links, and are pivotally interconnected by a pivot joint 76. A stop 78 on the link acts to restrict travel of the ottoman linkage 46, as seen in, for example, FIG. 6. The link 62 is pivotally connected to the link 64 by a pivot joint 80. The link 64 crosses the link 60 in scissors-like fashion at respective intermediate portions at which the links 64, 60 are pivotally interconnected by a pivot joint 82. Link 60 is pivotally interconnected to the link 66 by the pivot joint 84. The link 64 is connected to the link 58 by the pivot joint 86.

A guide link 88 is pivotally connected by the pivot joint 84 to the intersection of the links 66 and 60. The guide link 88 also includes a slot 90 that forms two camming surfaces 92 and 94. A pin 96 is received in the slot 90 and connected to the link 64. The pin 96 is formed of nylon or other self-lubricating material where it contacts either camming surface 92 or 94 of the guide link 88. At the upper end of the guide link 88, a medially directed flange 98 is formed, and a respective end of a second member (not shown) of the ottoman 16 may be mounted thereon.

Turning again to the rear portion of the mechanism 20, a chair back mounting link 100 is pivotally connected to the seat and arm mounting plate 24 by pivot joint 102, and the chair back mounting link 100 is also pivotally connected to the connecting link 50 by pivot joint 104. As previously described, the lower end of the connecting link 50 is connected to the v-shaped link 42 by a pivot joint 106, while the v-shaped link 42 is pivotally connected to the seat and arm mounting plate 24 by pivot joint 48 and to the support plate 38 by a pivot joint. A stop 108 is formed on the connecting link 50 to limit the forward (clockwise as seen in FIG. 3) pivoting movement of the chair back mounting link 100 to prevent discomfort to the user.

Figure 12:
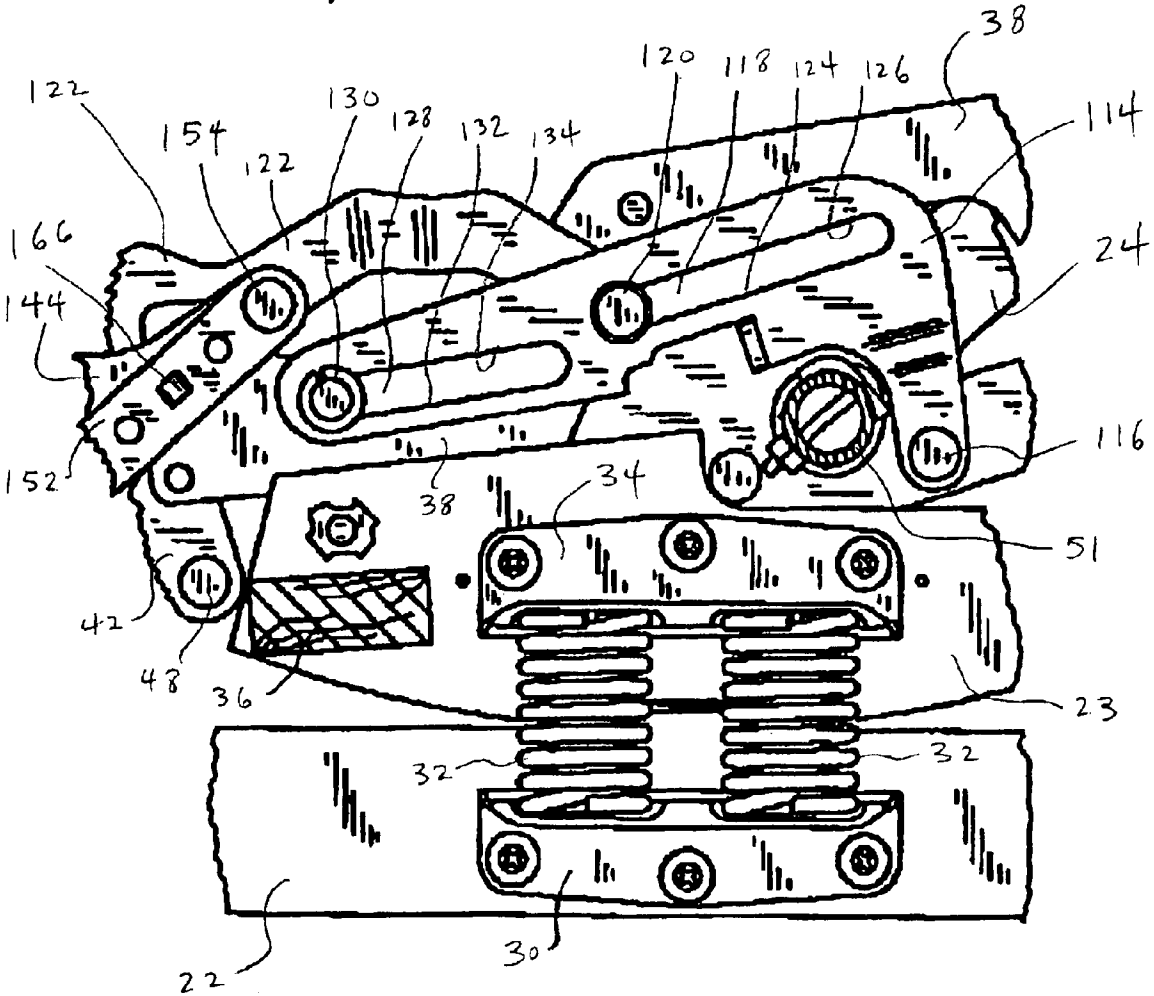
FIG. 12 is a detail view of the mechanism of FIG. 3.

A rocker locking assembly 110 is provided as part of the operating mechanism 20 to advantageously prevent rocking motion of the chair 10 when the ottoman linkage 54 is extended, thereby enhancing the stability of the chair. The rocker locking assembly 110 includes a crank element 112 that is fixedly connected to the torque tube 51 and pivotally connected to a main drive link 114 by a pivot joint 116. The main drive link 114, in its preferred embodiment, has two slots formed therein:

(a) a first slot 118 in which a pin 120 attached to a longitudinal drive element 122 is received so that the pin 120 is capable of sliding movement along the slot 118. The pin 120 has a contacting surface of nylon or other self-lubricating material. As seen in the detail view of FIG. 12, The walls of the first slot 118 form a first camming surface 124 and a second camming surface 126 which meet at the ends of the slot 118. The first camming surface 124 contacts and cams the pin 120 when the main drive link 114 is driven rearwardly by rotation of the handle 18 in a counterclockwise direction (as viewed for example, in FIG. 5). When the main drive link 114 is moved forwardly by rotation of the handle 18, the second camming surface 126 contacts and cams the pin 120. It will be understood that by varying the profile or shape of the first slot 118, the force required to turn the handle 18, and the direction in which that force is applied to the rocker locking assembly 110, can be varied.

(b) The main drive link 114 also includes a second slot 128, in which a pin 130 attached to a rearward portion of the support plate 38 is received. The pin 130 also advantageously has a contacting surface of nylon or other self-lubricating material. As illustrated in the detail view of FIG. 12, the second slot 128 includes a first camming surface 132 and a second camming surface 134 for contacting the pin 130 during, respectively, rearward and forward motion of the main drive link 114. The shape or profile of the second slot 128 can likewise be varied to modify the operating characteristics of the rocker locking assembly 110. By varying the respective profiles of the first slot 118 and the second slot 128, a further variety of operating characteristics, including the force required to operate the rocking locking assembly 110 and the directions in which that force is applied, can be modified in a variety of ways. Likewise, the relative size, shape, and length of the first slot 118 and the second slot 126 can be varied to achieve different operating characteristics such as smoothness of operation and ease of operation.

Figure 9:
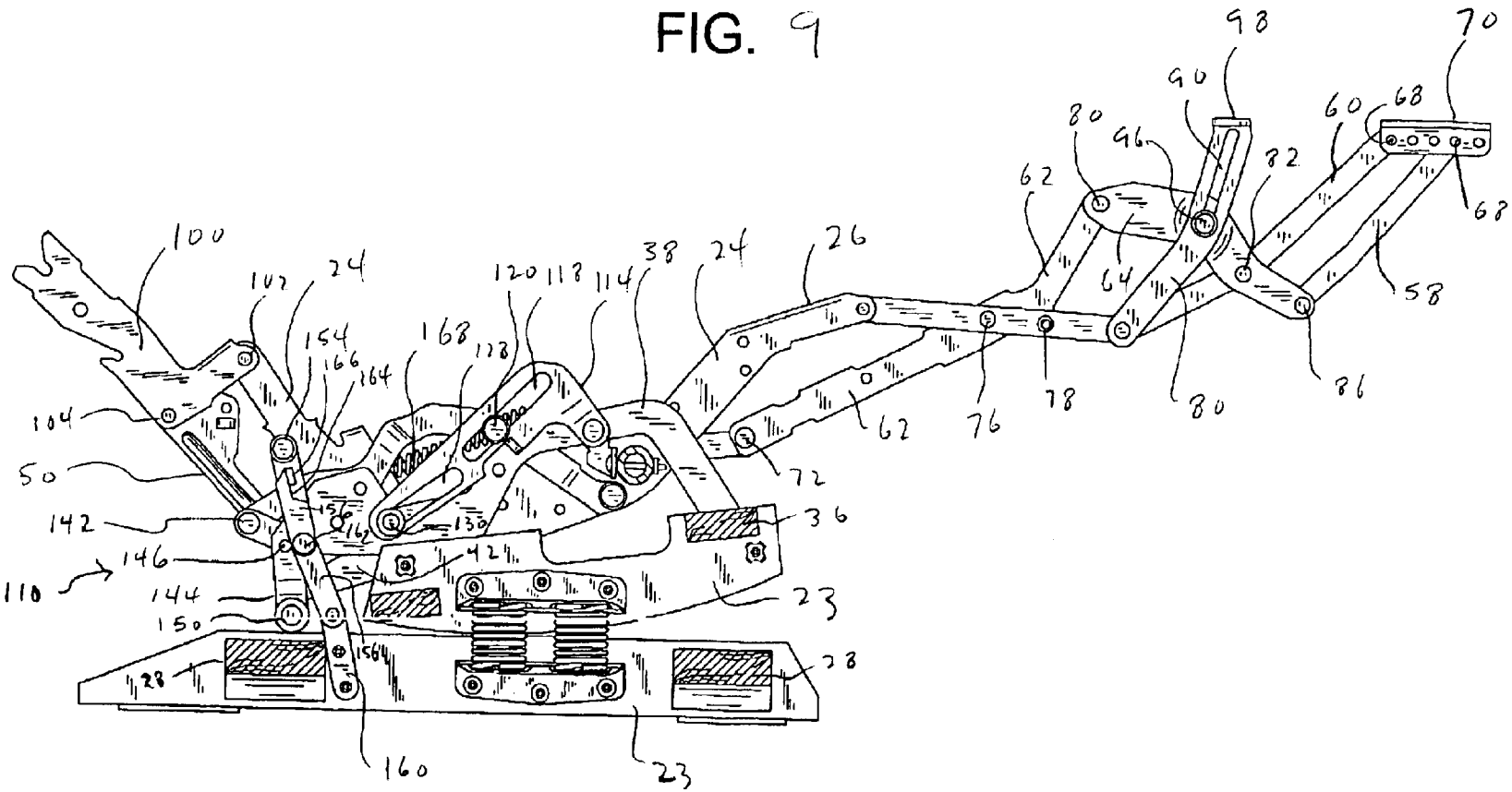
FIG. 9 is a side elevational view of the left side linkage of FIG. 3 in the fully reclined position.

The longitudinal drive clement 122 is pivotally mounted at an intermediate location along its length to the support plate 38 by a pivot joint 136. As described above, the forward end of the longitudinal drive element 122 is attached to a pin 120 that is received in the first slot 118. The rearward end of the longitudinal drive element 122 it is pivotally connected to a connecting link 140 by a pivot joint 142. At a location rearward of the pivot joint 142, the longitudinal drive element 122 is pivotally connected to the upper forward end of the v-shaped link 42 by the pivot joint 143 (as best seen in FIG. 9).

Figure 5:
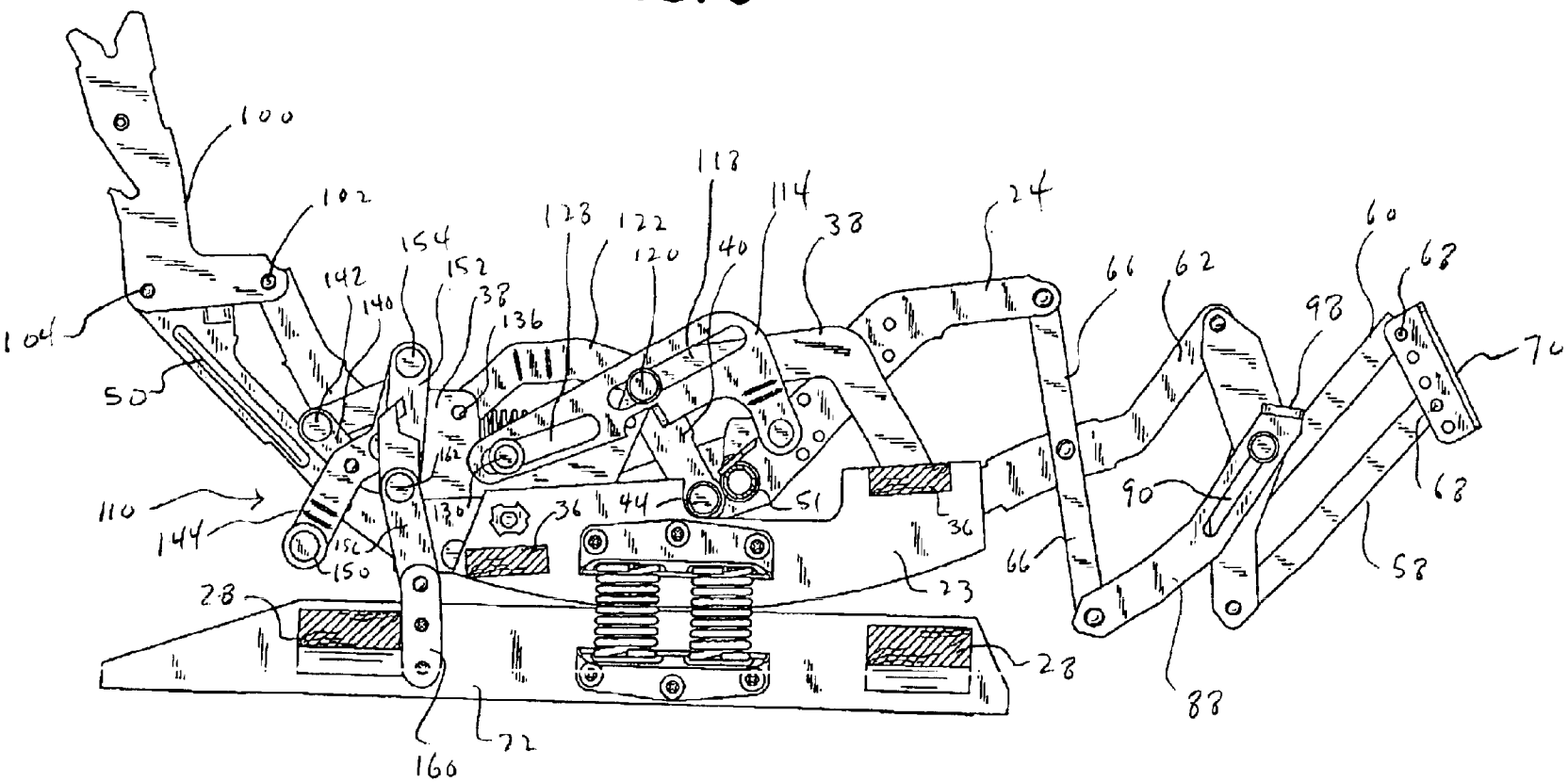
FIG. 5 is a side elevational view of the left side linkage of FIG. 3, with the ottoman linkage partially extended.

The connecting link 140 is in turn pivotally connected to a pivot link 144 by pivot joint 146 for the purpose of driving the pivot link 144 through a range of motion to lock the chair 10 from rearward rocking motion, and to release the lock. The pivot link 144 is pivotally mounted on the support plate 38 at an intermediate location along the pivot link 144's length by a pivot joint 148 (as seen in FIG. 5).

The pivot joint 146 which as described earlier connects the pivot link 144 to the connecting link 140, is located at an intermediate location along the length of the pivot link 144, somewhat below and rearward of the pivot joint 148 in the position of FIG. 5. At its lowermost end, the pivot link 144 has a lock roller 150 formed thereon for engaging the top surface of the base member 22 to provide the aforementioned locking of the chair 10 against rearward rocking motion. The lock roller 150 may advantageously have a contacting surface of nylon or other resilient material.

At its uppermost end, the pivot link 144 is pivotally connected to a first locking link 152 by pivot joint 154. The first locking link 152 is, at its lower end, pivotally connected to a second locking link 156 by a pivot joint 158. The second locking link 156 is connected at its lower end to a fixed locking link 160 by a pivot joint 162, while the fixed locking link 160 is fixedly connected to the base member 22 by threaded fasteners or other appropriate arrangement.

The pivot joint 158 connecting the first locking link 152 and second locking link 156 is located at an intermediate portion along the length of the second locking link 156. The upper end of the second locking link 156 has a locking profile 164 with a notched profile forming a shoulder or "duck bill" shape. The locking profile 164 is shaped to engage a stop 166 formed on the first locking link 152 to restrict the motion of the second locking link 156.

Figure 7:
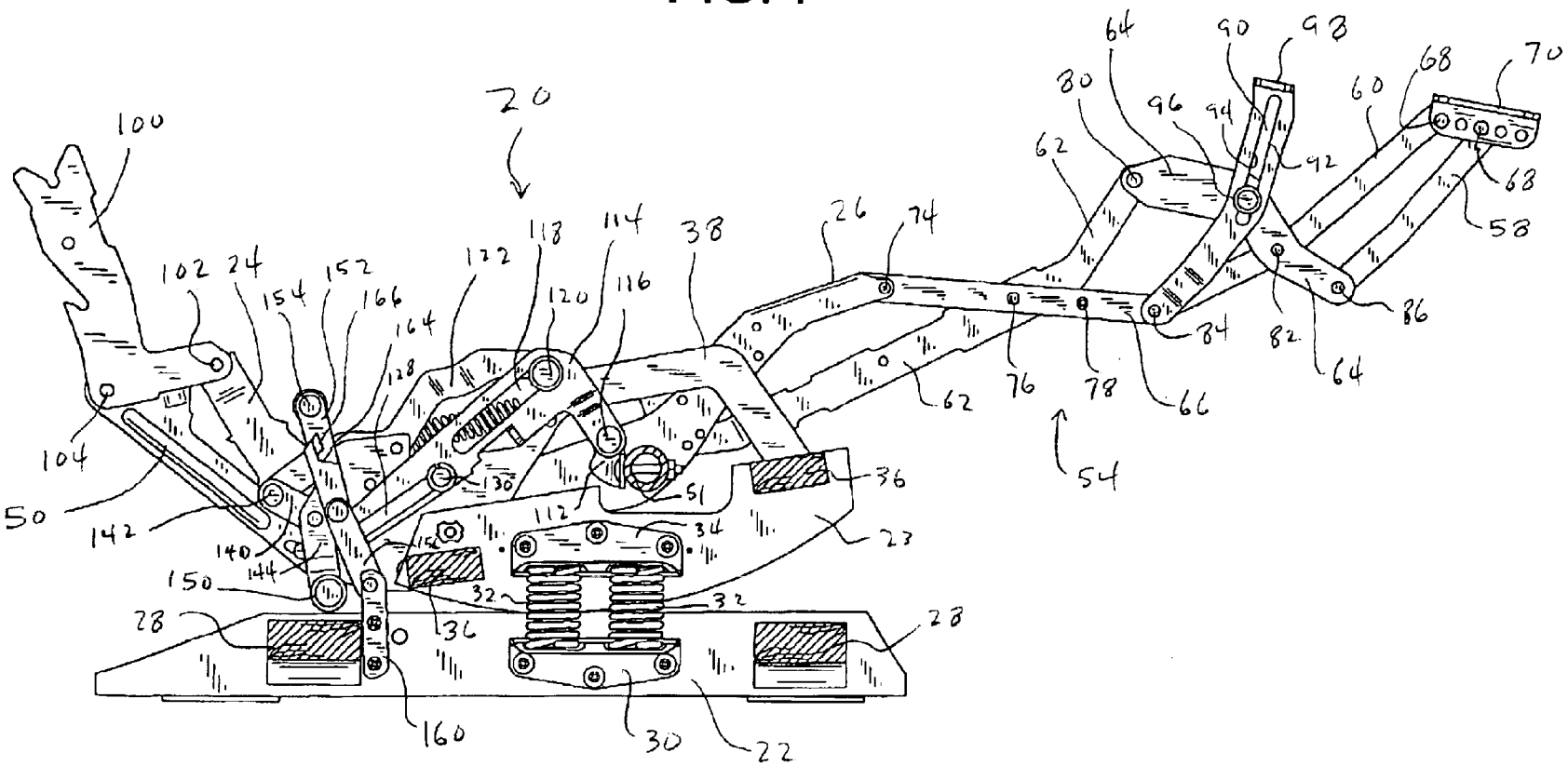
FIG. 7 is a side elevational view of the left side linkage of FIG. 3 in the TV position.

As seen in FIGS. 3, 5, 7, and 9, the first and second locking links 152, 156, have a respective range of motion that permits them to move into a substantially aligned orientation, as show in FIGS. 7 and 9. In this orientation the pivot joints 154, 158, and 162 are also substantially aligned, and the locking profile 164 is in contact with the stop 166. In this arrangement, the substantial alignment of the first and second locking links 152, 156 locks the chair 10 from forward rocking motion.

Figure 10:
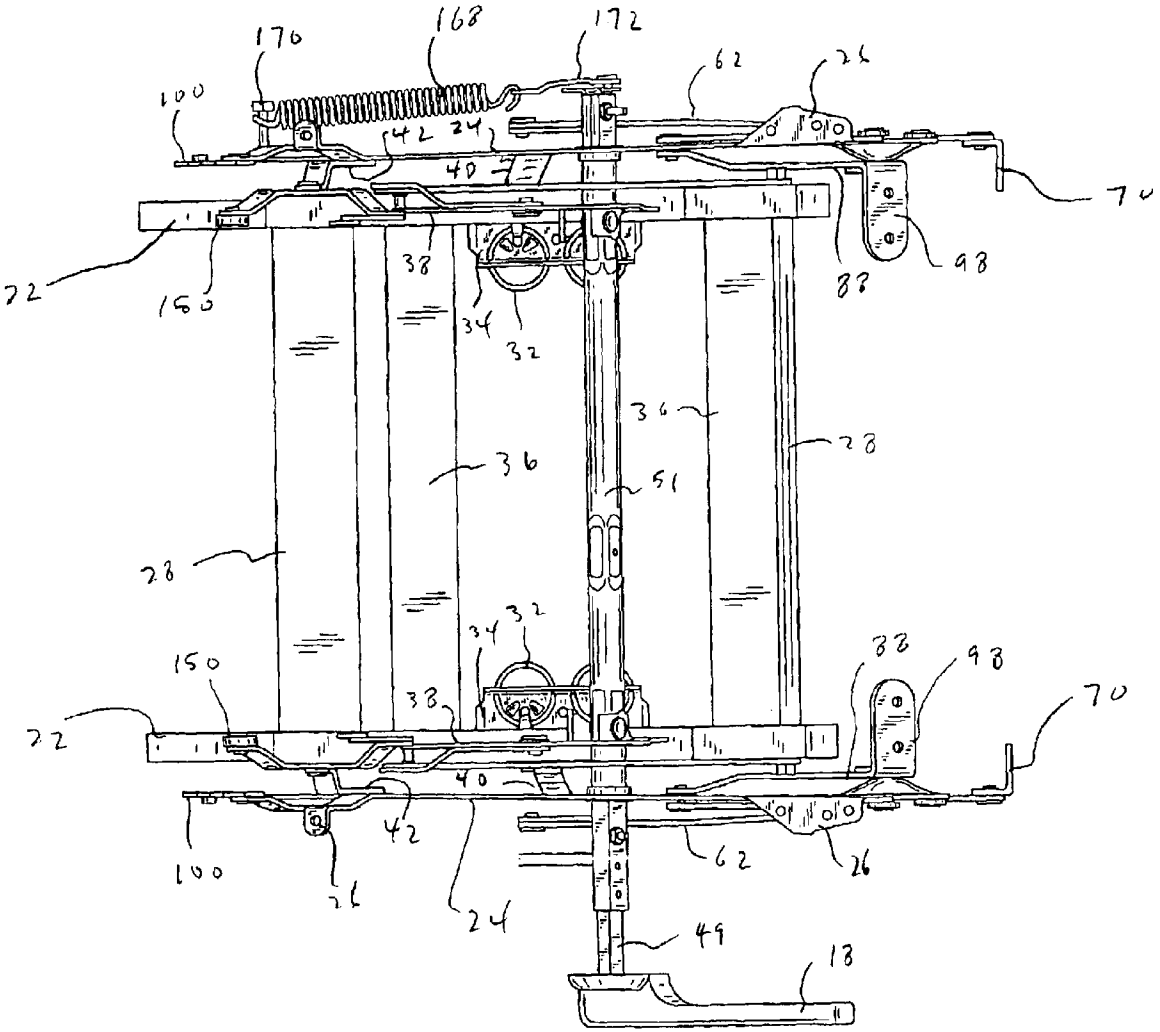
FIG. 10 is a diagrammatic top plan view of the mechanism in the upright position.
Figure 11:
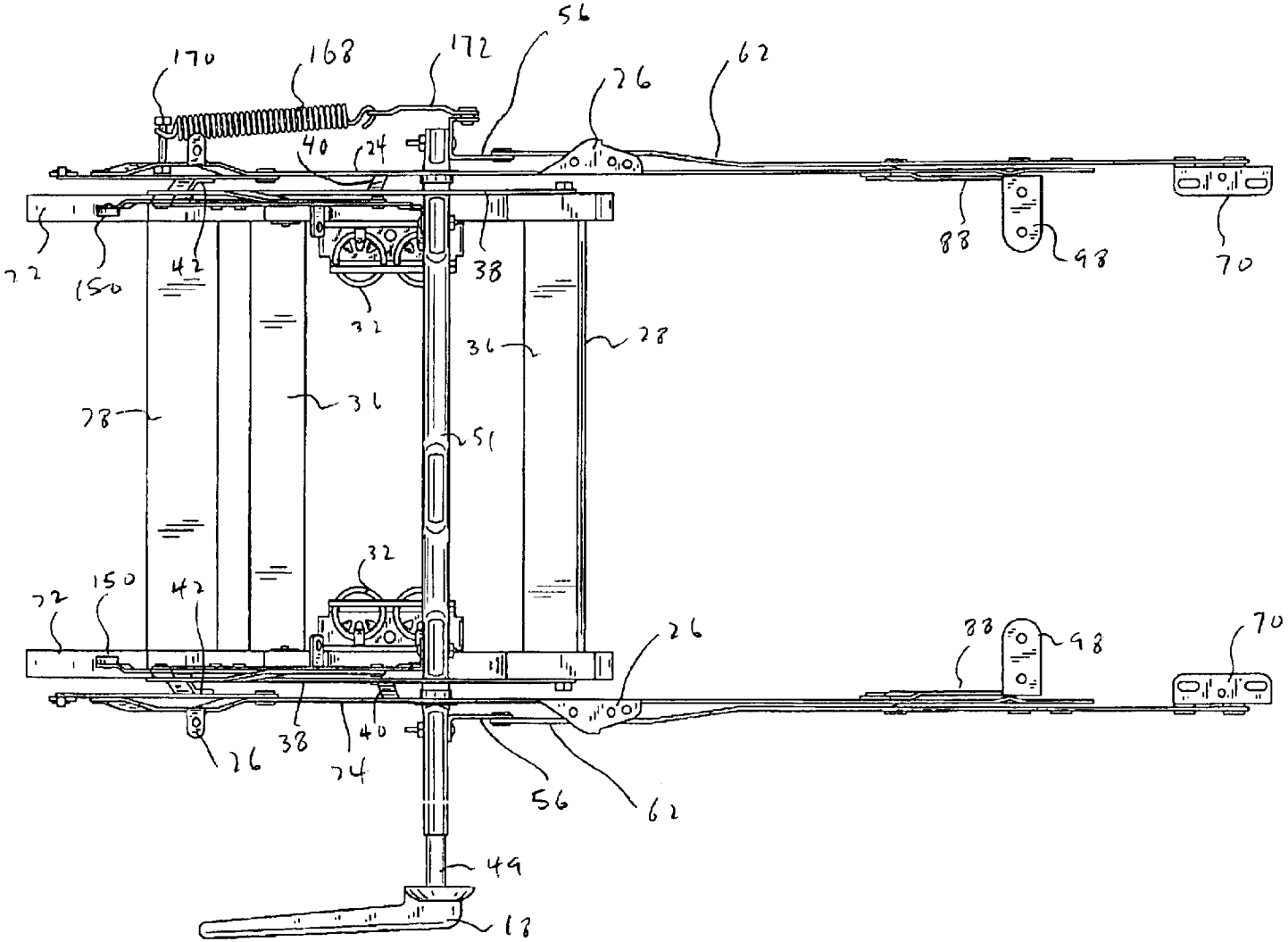
FIG. 11 is a diagrammatic top plan view of the mechanism in the TV position.

As best seen in FIG. 10, a spring 168 is mounted on a pin 170 and a spring mounting element 172 to provide biasing of the ottoman linkage 54 in the closed position, and to provide some assistance to the user in fully extending the ottoman linkage through the latter portion of its extending motion. It will be understood by those of skill in the art that other springs can be employed in the operating mechanism 20 to assist its operation. The pin 170 is mounted on a rearward portion of the seat and arm mounting plate 24, while the spring mounting element 172 is attached to the torque tube 51 and rotates with the torque tube 51.

To operate the mechanism 20 of the chair 10, the user assumes a comfortable seating position and pulls the handle 18 rearwardly (in a counterclockwise direction from the perspective of FIG. 2). The ottoman linkage 54 will be driven by rotation of the torque tube 51 to begin extending, as shown in FIGS. 4 and 5. At the same time, the rocker locking assembly 110 will be put into motion, as the main drive link 114 is also driven by rotation of the torque tube 51. As the main drive link 114 moves rearwardly, pin 120 is slidingly clammed in slot 118 along the first camming surface 124, which drives the longitudinal drive element 122 upwardly at its forward end. As a result, the longitudinal drive element 122 is caused to pivot around pivot joint 136, and its rearward end moved downwardly, driving the connecting link 140 downwardly as well, which in turn causes the pivot link 144 to rotate in a counterclockwise direction (as seen in FIG. 5) to move the lock roller 150 on the pivot link 144 downwardly. First and second locking links 152, 156 also are driven by movement of the pivot link 144 toward a more generally aligned orientation.

Figure 6:
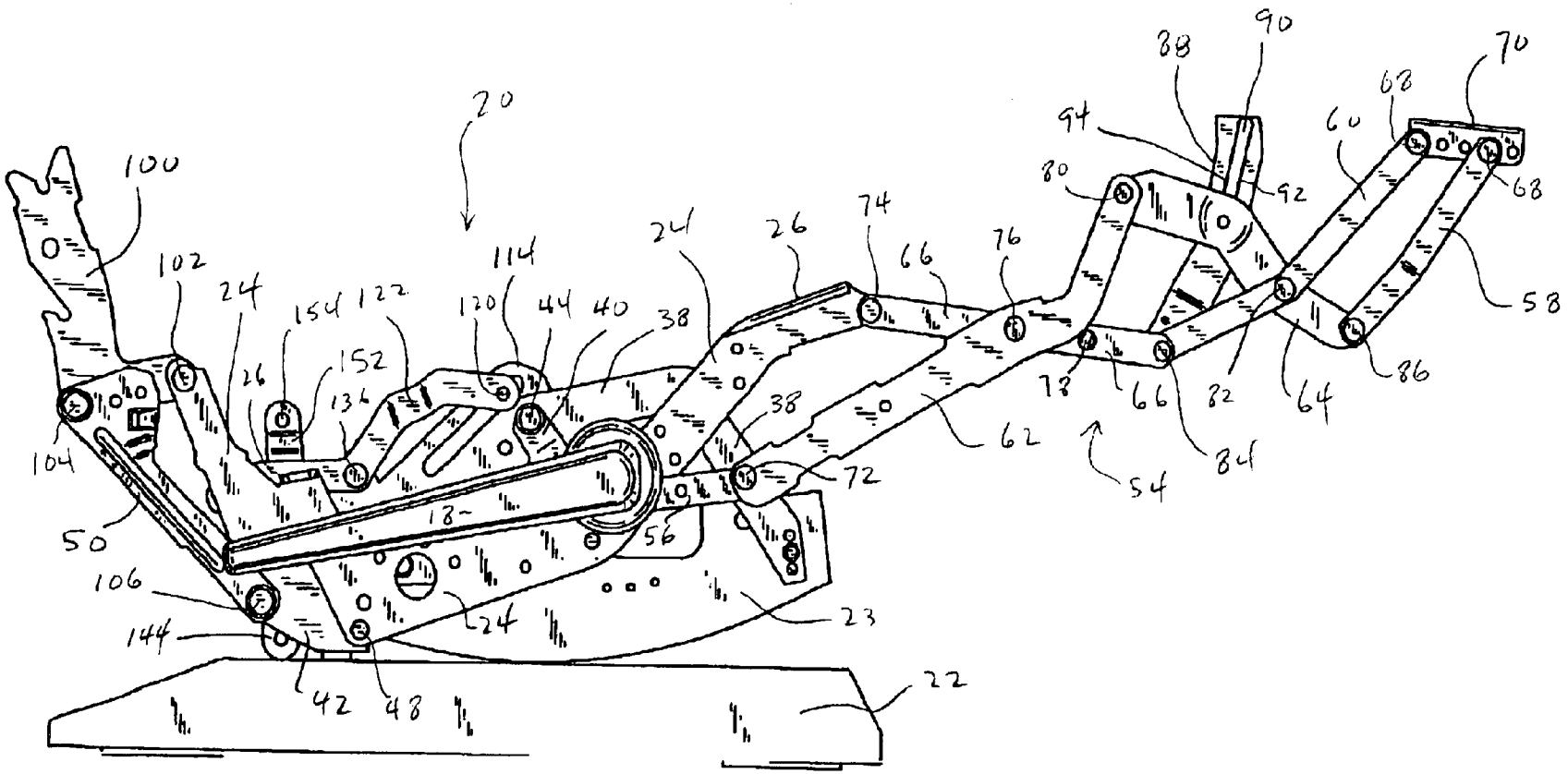
FIG. 6 is a side elevational view of the right side linkage of FIG. 2 in the TV position wherein the ottoman linkage is fully extended.

As motion of the handle 118 reaches the end of its rearward (or counterclockwise as seen in FIG. 6) travel, the ottoman linkage 54 is extended, placing the ottoman mounting bracket 70 and flange 98 (and the upholstered ottoman 16 mounted thereto) in an upwardly extended position. The pin 96 in the slot 90 guides the movement of the guide link 88 to place the flange 98 in the desired position for the secondary member (not shown) of the ottoman 16. Stop 67 on rear second link 66 acts to limit the extending motion of the ottoman linkage 54.

Full rotation of the handle 18 also brings the rocker locking assembly 110 into its locking position. As seen in FIG. 7, the pivot link 144 is fully pivoted so that the lock roller 150 contacts the top surface of the base member 22, to lock the chair 10 from rearward rocking motion. The first and second locking links 152, 156 are brought into substantially aligned orientation, thereby locking the chair 10 from forward rocking motion. It should be noted that in this position, the locking profile 164 on the upward end of the second locking link 156 is brought into locking engagement with the stop 166 on the first locking link 152.

The downward motion of the rearward end of the longitudinal drive element 122 (caused by operating the handle as described) also applies downward force on the v-shaped link 42 through the pivot link 143. This pushes the rearward end of the arm and seat mounting plate 24 downwardly and causes the seat and arm mounting plate 24 to swing forwardly and upwardly on the forward swing link 40 and the v-shaped link 42, causing the upholstered seat and arm 12 of the chair to adopt a more reclined orientation. In this way, full extension of the ottoman linkage 54 by operating the handle 18 causes reclining of the chair, as well as locking of the rocker locking assembly 110. The resulting position, as shown in FIGS. 6 and 7 is generally known as the TV position, in which the user is in a posture sufficiently upright to view television, read, or converse in comfort with the upholstered ottoman 16 extended.

Figure 8:
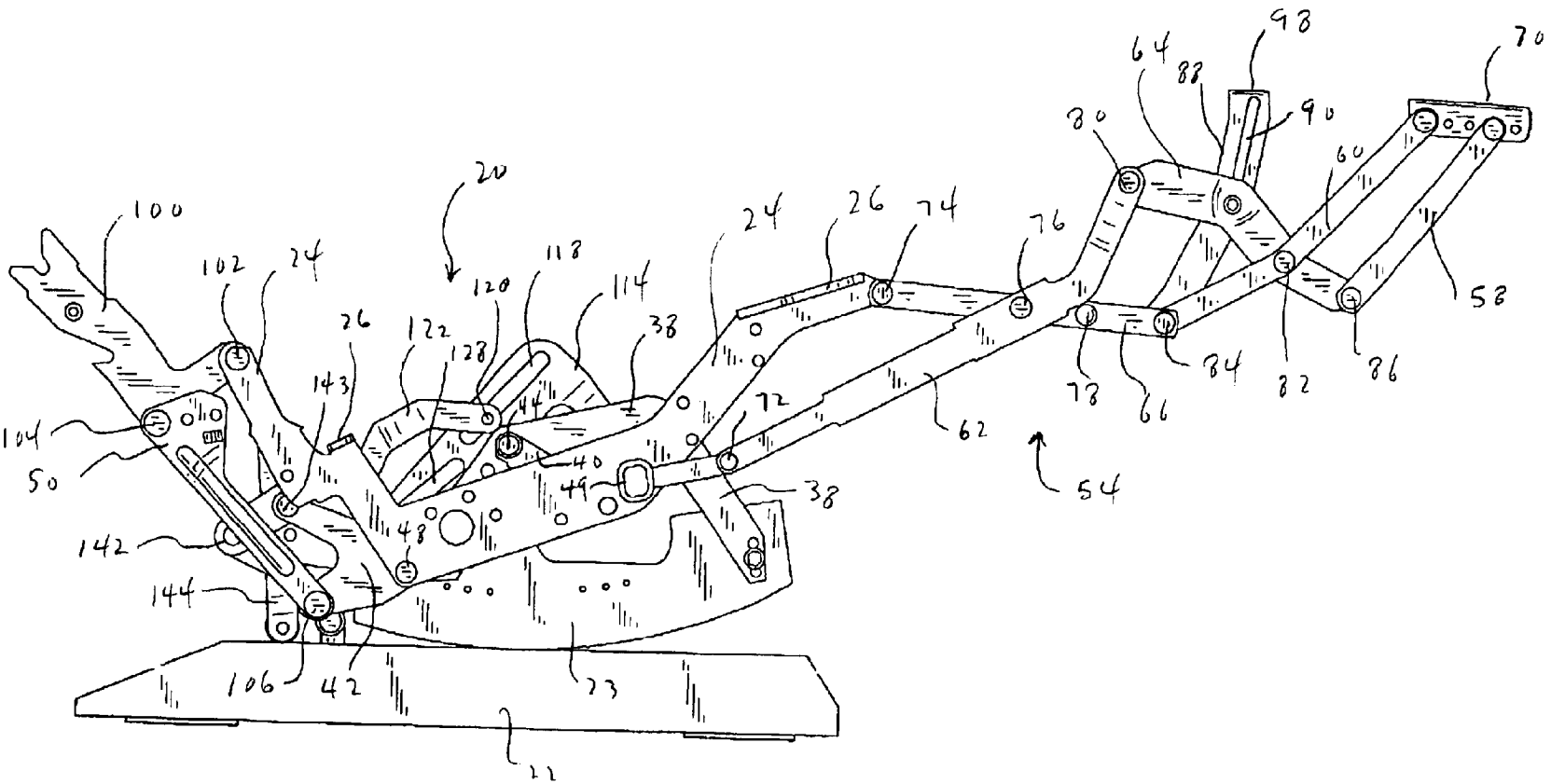
FIG. 8 is a side elevational view of the right side linkage of FIG. 2 in the fully reclined position with the handle omitted for clarity.

The chair 10 may be brought in a Full Recline position, as shown in FIGS. 8 and 9, in the following manner. The user can exert rearward force on the upholstered back 14 of the chair, and cause the chair back mounting link 100 to rotate in a counterclockwise direction (as seen in FIG. 9 for example) causing reclining of the back 14. This movement in turn causes the back connecting link 50 to move downwardly and forwardly, and through the v-shaped link 42 a force is exerted on the seat and arm mounting plate 24, causing it to swing forwardly and upwardly on the forward swing link 40 and v-shape link 42. Thus, the seat and arm mounting plate 24 is brought into a further reclined position, and this causes the ottoman linkage 54, which is mounted on the seat and arm mounting plate 24, to move further forwardly and upwardly, achieving a greater pitch or degree of recline for the chair 10 as a whole. Actuation of this movement is, as described above, caused by the user pressing rearwardly on the back 14 of the chair.

The slots 118, 128 of the main drive link 114 facilitate full reclining of the chair 10 while maintaining its stability. As the seat and arm mounting plate 24 swings forwardly and upwardly, the main drive link is also moved forwardly and upwardly by its connection to the torque tube 51 (which is journaled in the seat and arm mounting plate 24). The slot 118 permits the pin 120 to slide along the slot 118 and to otherwise remain generally stationary as the main drive link 114 moves, thus maintaining the longitudinal drive element 122 in a generally stationary position and leaving the rocker locking assembly 110 in the locked position. The slot 128 permits the pin 130 to slide along the length of the slot 128 as the main drive link 114 moves, without exerting a substantial force on the main drive link 114. In this way, the main drive link 114 does not move substantially with respect to the torque tube 51, and the torque tube 51 is not rotated so as to cause a change in the extension/retraction of the ottoman linkage set 54. It will be understood that the shape of the slots 118, 128 can be varied so as to create desirable operating characteristics in this regard.

The mechanism of the chair of the present invention achieves several advantageous benefits. A greater pitch or degree of recline is achieved, while maintaining the chair in a position locked against either forward or rearward rocking motion. The slots 118, 128 provided in the main drive link 114, and the resulting camming surfaces formed in those slots, allows smooth and efficient operation of the mechanism of the chair, while reducing the number of parts required. Likewise, the slot 90 and camming surfaces formed in the guide link 88 also permit the ottoman to be extended easily and efficiently, while requiring fewer parts.

The upholstered elements of the chair can be provided in a wide range of styles and designs, as desired. The mechanism of the chair is preferably made of conventional materials, e.g., steel plate, punched, bent, bored and painted flat black; steel pins; self-lubricated plastic washer-like bushings for joints and contact surfaces, steel rivet-type pivot joints, and other appropriate materials, attention being given to thickness and strength given that the chair is preferably for use by a wide variety of people, including tall and heavy users.

The principles of the invention have been shown and explained in relation to a free-standing, single seat rocking chair having two arms. However, the principles of the invention can be applied to motion seating furniture in which the upholstered seat and arm frame is one-armed (as in a recliner unit for an end of a multiple seat sectional sofa having one arm), or is replaced by an armless upholstered seat frame (as in a recliner unit for an armless end of a multiple seat sectional sofa).

It should be apparent that the rocker recliner chair and mechanism as described herein possesses the attributes set forth in this specification. Because the invention can be modified to some extent without departing from its principles as they have been outlined and explained in the specification, the present invention should be understood as encompassing all such modifications as are within the spirit ad scope of the following claims.

What is claimed is:

1. A recliner mechanism for a rocker chair, comprising:

a base;

left and right rocker cam assemblies each including a rocker cam positioned at a cam bearing location relative to said base for forward and rearward rocking motion, said rocker cam assemblies being fixedly interconnected;

left and right side linkages; each including:

a seat mounting surface being connected to one of said rocker cam assemblies;

an ottoman linkage driven by a handle-operated torque tube to move an ottoman between an extended position and a refracted position, said ottoman linkage including a crank link connected to said torque tube; and a rocker locking assembly driven by said torque tube to lock said rocker cam assemblies against rocking motion when said ottoman is in the extended position, said rocker locking assembly including a drive link interpivotally connected to said torque tube, said drive link being slidingly connected to a drive element for driving a locking element and slidingly connected to one of said rocker cam assemblies, wherein said drive element drives a plurality of locking elements interpivotally connected to each other, one of said locking elements being pivotally connected to said base, said locking elements being movable to a locking position in which said locking elements align to prevent forward rocking motion of said rocker cam assemblies, and wherein said drive element drives a pivot link mounted on one of said rocker cam assemblies for pivotal movement between a non-locking position and a locking position in which said pivot link engages said base to prevent rearward rocking motion of said rocker cam assemblies.

2. The mechanism of claim 1, wherein said pivot element and said plurality of looking elements are interpivotally connected.

3. A recliner mechanism for a rocker chair, comprising:

a base;

left and right rocker cam assemblies each including a rocker cam positioned at a cam bearing location relative to said base for forward and rearward rocking motion, said rocker cam assemblies being fixedly interconnected;

left and right side linkages; each including:

a seat mounting surface being connected to one of said rocker cam assemblies, an ottoman linkage driven by a handle-operated torque tube to move an ottoman between an extended position and a retracted position, said ottoman linkage including a crank link connected to said torque tube; and a rocker locking assembly driven by said torque tube to lock said rocker cam assemblies against rocking motion when said ottoman is in the extended position, said rocker locking assembly including a drive link interpivotally connected to said torque tube, said drive link being slidingly connected to a drive element for driving a locking element and slidingly connected to one of said rocker cam assemblies, wherein said ottoman linkage further includes a guide link pivotally connected to a first ottoman link and slidingly connected to a second ottoman link.

4. A mechanism for a rocking reclining chair which includes an upholstered seat, an upholstered back, and an ottoman, comprising:

a base arranged to be supported on a floor;

left and right side rocker cam assemblies each including a rocker cam positioned at a cam bearing location on said base for forward and rearward rocking motion, said rocker cam assemblies being fixedly interconnected by transverse members; left and right side linkages each including:

a set of pantographically interpivoted links for mounting the ottoman for extension to an extended position and retraction to a retracted position, said set of pantographically interpivoted links including a guide link having a slot formed therein, said slot being slidingly engaged with a portion of a second ottoman link to guide the guide link to an ottoman supporting position when said set of pantographically interpivoted links is in the extended position;

a first set of interpivoted support links for supporting the upholstered seat for movement between a more erect position achievable when the ottoman is in the retracted position, a recumbent position achievable when the ottoman is in the extended position, and a more recumbent position also achievable when the ottoman is in the extended position;

a second set of interpivoted support links for supporting the upholstered back for movement between a more erect position achievable when the ottoman is in the retracted or extended position, and a more recumbent position achievable when the ottoman is in the extended position;

a transversely extending torque tube journaled in said left and right side linkages for reversible rotation about its own longitudinal axis, said torque tube being operatively connected to said pantographically interpivoted links, for extending the ottoman upon rotation of the torque tube in one angular direction and for retracting the ottoman upon rotation of the torque tube in an opposite angular direction; and left and right locking linkages operatively connected to said torque tube, each of said linkages including a drive link interpivotally connected to said torque tube, said drive link cammingly engaging a drive element for driving a pivoting locking element for pivotal movement to selectively lock said chair against rearward rocking motion, said locking elements also driving a pair of locking links selectively movable to a locking position in which said pair of locking links align to prevent forward rocking motion of said chair.

5. The mechanism of claim 4, wherein the locking element is a roller.

* * * * *